United States Patent [19]

Preininger

[11] 4,301,437

[45] Nov. 17, 1981

[54] IMPEDANCE COIL CORE

[75] Inventor: Gustav Preininger, Graz, Austria

[73] Assignee: Elin-Union Aktiengesellschaft, Vienna, Austria

[21] Appl. No.: 102,329

[22] Filed: Dec. 11, 1979

[30] Foreign Application Priority Data

Dec. 12, 1978 [AT] Austria ..... 8827/78

[51] Int. Cl.[3] ..... H01F 27/08; H01F 17/04

[52] U.S. Cl. ..... 336/60; 336/178; 336/212; 336/219

[58] Field of Search ..... 336/60, 210, 212, 178, 336/219

[56] References Cited

U.S. PATENT DOCUMENTS

| | | | |
|---|---|---|---|
| 1,546,885 | 7/1925 | Burnham | 336/60 |
| 2,910,663 | 10/1959 | Wilk et al. | 336/60 X |
| 3,341,793 | 9/1967 | Wale et al. | 336/219 X |

FOREIGN PATENT DOCUMENTS

| | | | |
|---|---|---|---|
| 730718 | 1/1943 | Fed. Rep. of Germany | 336/219 |
| 497023 | 11/1919 | France | 336/60 |
| 630070 | 11/1927 | France | 336/60 |
| 229484 | 2/1925 | United Kingdom | 336/219 |

*Primary Examiner*—Thomas J. Kozma
*Attorney, Agent, or Firm*—Ernest F. Marmorek

[57] ABSTRACT

An impedance coil core which includes a plurality of core legs and yokes which interconnect the core legs in an assembled condition of the core is provided with aligned recesses in the yokes and in the core legs for accommodating tensioning bolts which extend into the recesses and press the yokes against the core legs in the assembled condition. Each of the core legs includes a plurality of laminated assemblies including sheet metal elements. Those portions of the yokes and at least of the laminated assemblies adjoining the latter are provided with non-magnetic intermediate layers in the central region which is provided with the recesses. The intermediate layers in the core legs are wedge-shaped and diverge toward the adjacent yokes, and the intermediate layers in the yokes are cross-sectionally rectangular.

3 Claims, 3 Drawing Figures

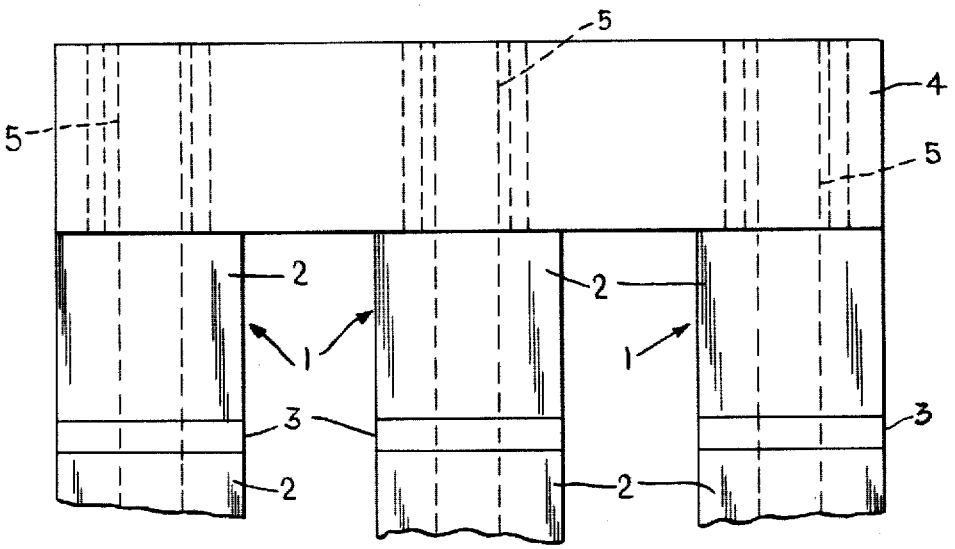
FIG 1
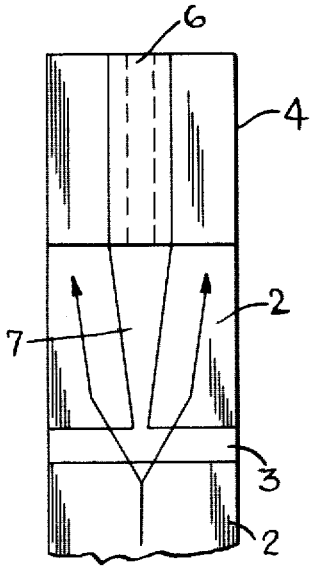
FIG 2
FIG 3
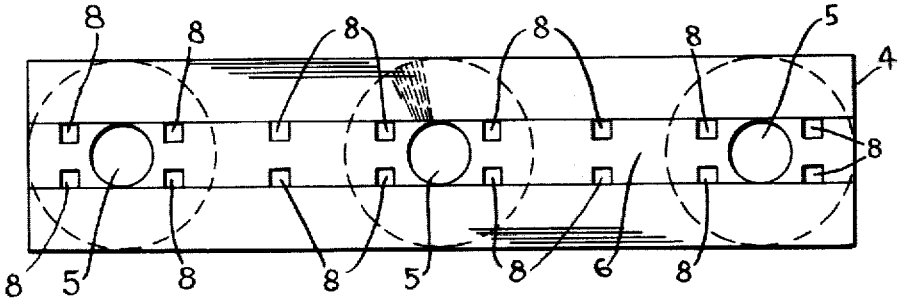

IMPEDANCE COIL CORE

The invention relates to an impedance coil core, including core legs which consist of individual cylindrical laminated assemblies including radially arranged sheet metal elements, which are separated from one another by non-magnetic intermediate layers, and yokes connecting the core legs and each having a rectangular or step-like cross-section. The core legs and the yokes include cylindrical recesses which may be aligned with one another for receiving centrally located tension bolts.

In impedance coils, in particular in compensating impedance coils, a construction of the core is used in which the core legs consist of individual cylindrical laminated assemblies including radially arranged sheet metal elements and non-magnetic distancing elements. In three-phase current impedance coils, three core legs, which in most instances lie in one plane, are interconnected by a lower and an upper yoke each of which, in the simplest case, has a rectangular cross-section. The core legs, as well as the yokes have cylindrical recesses, for receiving centrally located tension bolts, with the aid of which the entire structure is compressed and held together. As a result of the provision of these recesses, a zone is formed in the yoke, in which the magnetic flux-paths are interrupted by the recesses for the tension bolts. The magnetic flux which, for example, must pass from one outer leg to the other, is now forced to deviate transversely to the sheet metal elements into the marginal zones, as a result of which increased eddy current losses and dangerous temperature rises may arise particularly at the borders of the recesses. A known remedy, for example, is the provision of transverse yokes, through which the magnetic flux is deflected from the central portion into the marginal zones.

SUMMARY OF THE INVENTION

Accordingly, it is an object of the invention to create an impedance coil core, in which the above cited disadvantages are eliminated, but which is, nevertheless, simple and economical in its construction, as well as in production.

The impedance coil core designed according to the invention is characterized in that the laminated assemblies of the core legs which adjoin the yokes include non-magnetic intermediate layers which, in a cross-sectional view, diverge in a wedge-shaped manner toward the yokes, that the yokes include non-magnetic intermediate layers each having a rectangular cross-section, and that these intermediate layers are arranged in the central area which is interrupted by the recesses. Due to the invention, it is possible for the first time to produce an impedance coil core of the initially cited type, in which the magnetic flux is guided in an optimum manner. Thus, no eddy current losses and also no temperature rises are encountered at the border regions of the recesses. The magnetic flux is also guided in a faultless manner through the transition region between the core legs and the yoke.

In accordance with a special feature of the invention, cooling ducts are arranged in the non-magnetic intermediate layers. As a result of this further development of the invention, it is possible to form the cooling ducts for the passage of cooling oil, by resorting to simple manufacturing procedures.

BRIEF DESCRIPTION OF THE DRAWINGS

The invention will be explained in greater detail with reference to the embodiment illustrated in the drawings.

FIG. 1 is a front elevational view of the impedance coil core in accordance with the present invention;

FIG. 2 is a side elevational view of the impedance coil core of FIG. 1; and

FIG. 3 is a top plan view of the impedance coil core of FIGS. 1 and 2.

DESCRIPTION OF THE PREFERRED EMBODIMENTS

In accordance with FIG. 1, a three-phase current impedance coil core consists of three core legs 1 which include individual cylindrical laminated assemblies 2 including radially arranged sheet metal elements. Between the individual laminated assemblies 2, there are arranged non-magnetic spacing elements 3. The three core legs 1, which are arranged in one plane, are connected with one another by means of an upper yoke 4 and a lower yoke which is not illustrated. The core legs 1, as well as the yokes 4 are provided with cylindrical recesses 5. By means of (non-illustrated) centrally disposed tension bolts which are arranged in the recesses 5 in the assembled condition of the impedance coil core, the core legs 1 and the yokes 4 are normally compressed and held together.

In order for a central region 6 of the yokes 4, from which the recesses 5 had been carved out, to be kept free of any magnetic flux, the region 6 is filled by a non-magnetic material (FIG. 3).

Since, eddy currents or inadmissible temperature rises could likewise occur in the transition of the magnetic flux from the core legs 1 to the yokes 4, the laminated assemblies 2 of the core legs 1, which adjoin the yokes 4, include non-magnetic intermediate layers 7 which, in cross-sectional view, diverge in a wedge-shaped manner. By means of these wedge-shaped intermediate layers 7, the magnetic flux is continuously conducted into the non-interrupted zone of the yokes 4. Consequently, neither eddy current losses, nor any inadmissible temperature rises, are encountered in the marginal zones. The arrangement employing auxiliary yokes is thus no longer necessary.

As shown in FIG. 3, cooling ducts 8 may be provided in the intermediate layer 6, through which cooling oil may be conducted to cool the core legs 1 and/or the yokes 4.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. In a coil, particularly in an impedance coil, of the type including a core having a plurality of core legs, each consisting of individual cylindrical laminated assemblies including radially extending sheet metal elements, and separated from one another by non-magnetic spacing layers, and yokes extending between the core legs in an assembled condition of the core, and wherein the yokes and the core legs are provided with aligned recesses for accomodating tensioning bolts pressing the yokes against the core legs in the assembled condition, the improvement wherein the laminated assemblies of the respective core legs which adjoin said yokes include non-magnetic wedge-shaped intermediate layers diverging toward the adjacent yokes, and said yokes include non-magnetic intermediate layers, said wedge-shaped and said intermediate layers being arranged at the central area of said core which is provided with said recesses.

2. The improvement as claimed in claim 1, and further comprising cooling ducts provided in said wedge-shaped and said intermediate layers.

3. The improvement as claimed in claim 1, wherein the aligned recesses are substantially cylindrical, and said non-magnetic intermediate layers and said wedge-shaped layers have rectangular cross-sections.

* * * * *